US006817847B2

(12) United States Patent
Agner

(10) Patent No.: US 6,817,847 B2
(45) Date of Patent: Nov. 16, 2004

(54) ROTARY PUMP HAVING A HYDRAULIC INTERMEDIATE CAPACITY WITH FIRST AND SECOND CONNECTIONS

(75) Inventor: Ivo Agner, Bad Homburg (DE)

(73) Assignee: LuK Fahrzeug-Hydraulik GmbH & Co. KG, Bad Homburg (DE)

( * ) Notice: Subject to any disclaimer, the term of this patent is extended or adjusted under 35 U.S.C. 154(b) by 0 days.

(21) Appl. No.: 10/296,369

(22) PCT Filed: Jun. 1, 2001

(86) PCT No.: PCT/EP01/06282

§ 371 (c)(1),
(2), (4) Date: Jun. 2, 2003

(87) PCT Pub. No.: WO01/94791

PCT Pub. Date: Dec. 13, 2001

(65) Prior Publication Data

US 2004/0091381 A1 May 13, 2004

(30) Foreign Application Priority Data

Jun. 8, 2000 (DE) ..... 100 27 990

(51) Int. Cl.[7] ..... F04C 2/344
(52) U.S. Cl. ..... 418/75; 418/133; 418/180
(58) Field of Search ..... 418/75, 78, 133, 418/180, 225

(56) References Cited

U.S. PATENT DOCUMENTS

| | | | | |
|---|---|---|---|---|
| 2,778,317 A | * | 1/1957 | Cockburn | 418/78 |
| 3,320,899 A | | 5/1967 | Von Thuengen et al. | |
| 5,046,933 A | * | 9/1991 | Haga et al. | 418/180 |
| 5,222,886 A | * | 6/1993 | Fischer et al. | 418/133 |
| 5,266,018 A | * | 11/1993 | Niemiec | 418/133 |
| 5,277,565 A | * | 1/1994 | Schellekens et al. | 418/133 |

FOREIGN PATENT DOCUMENTS

| | | | |
|---|---|---|---|
| CH | 157744 | * 12/1932 | 418/180 |
| DE | 418430 | * 9/1925 | 418/180 |
| EP | 0 481 347 | 4/1992 | |
| FR | 405.613 | * 11/1909 | 418/180 |
| WO | WO 99/09322 | 2/1999 | |

OTHER PUBLICATIONS

DE 38 09 334—Abstract of German patent titled "Slide Vane Pump Underpressure Relief Narrow Passage Connect Pump Inlet", published on Oct. 5, 1989—(original patent is unobtainable).

DE 41 20 757—Abstract of German patent titled "Slide Vane Fluid Pump Damp Chamber Housing Reduce Noise Pressure Pulsate", published on Jan. 2, 1992—(original patent is unobtainable).

DE 197 07 119—Abstract of German patent titled "High Pressure Pump One Axis Through Bore One Control Plate Pressure Aperture", published on Aug. 13, 1998—(original patent is unobtainable).

* cited by examiner

*Primary Examiner*—John J. Vrablik
(74) *Attorney, Agent, or Firm*—Morriss O'Bryant Compagni, P.C.

(57) ABSTRACT

The invention relates to a pump with a pump chamber with a rotary-driven pump element mounted, at least one suction and at least one pressure connection opening into the pump chamber and with circulating pumping cells whose volume can be changed, which are connected with the suction or pressure connection depending on the rotary position of the pump element. A hydraulic intermediate capacity is provided that can be stressed with the pumping medium pressure present at the pressure connection by way of its first connection and that, by way of its second connection, can be stressed with the pumping medium pressure present at the pressure connection depending on the rotary position of the pump element or it can be connected with a pumping cell that has no direct connection to the pressure connection.

39 Claims, 4 Drawing Sheets

ROTARY PUMP HAVING A HYDRAULIC INTERMEDIATE CAPACITY WITH FIRST AND SECOND CONNECTIONS

RELATED APPLICATIONS

The present application is a U.S. National Phase Application of PCT/EP01/06282, filed Jun. 1, 2001 (incorporated herein by reference), which claims priority to German Patent Application No. 10027990.2, filed Jun. 8, 2000.

BACKGROUND

The invention relates to a pump with a pump chamber with a rotary-driven pump element, at least one suction connection opening into the pump chamber and at least one pressure connection and with circulating pumping cells with changeable volumes that are each connected with the suction connection or pressure connection, depending on the rotary position of the pump element.

Pumps of the type addressed here are known e.g. as vane-cell and roller-cell pumps in which the pumping cells are delimited by the pump chamber wall and the pump elements, whereby the pump elements are designed either as vanes or rollers that are held by the rotary-driven pump element, which in this way forms the rotor of the pump. In these pumps, it is known that in operation they are subject to pressure pulsation, which on one hand develops because of the laws of pumping and on the other hand because of pressure compensation processes in the transition of the pumping cells from suction connection to pressure connection and/or from pressure connection to suction connection. In the prior art, an attempt has been made to control the pressure compensation processes by using small slots that are formed in the pump chamber walls and are in connection with the suction and/or pressure connection. A pump design of this type with slots is known e.g. from DE 196 26 211 A1.

However, it has been found that the pressure compensation processes cannot be controlled and/or influenced in a satisfactory manner in all application cases of the pump. In particular, with a high percentage of undissolved air in the pumping medium, pressure pulsations often play a dominating role because of the pressure compensation processes. In particular, this is the pressure compensation process that takes place when a pumping cell transitions from suction connection to pressure connection. Because of the amount of undissolved air in the pumping medium, the elasticity of the pumping medium is increased. In this case, greater volume flows are necessary to pre-stress the pumping medium in the pumping cell and thus to bring it to the proper pressure. This leads to problems especially during the pre-compression or pre-filling process, as it is called.

Problems also occur, especially if the degree of foaming in the pumping medium, i.e. the percentage of undissolved air in the pumping medium, is very different over the operating range of the pump. In the known pump with slots, no satisfactory compromise can be found in the slot design. Therefore, especially at the edges of the pump operating status spectrum, limitations in the control of the pressure compensation processes have to be taken into consideration, the edges of the operating status spectrum lying at low pumping pressure and a low degree of foaming and high pressure and a high degree of foaming. With low degrees of foaming in the pumping medium, smaller volume flows are required for the pressure compensation process than with greater foaming in order to obtain similar pressure gradients. The volume flow that takes place during flow through a slot is mainly dependent on the pressure difference that occurs and the cross section of the slot. The dependence of the volume flow generated on the elasticity of the pumping medium is almost insignificant so that the foaming and/or the degree of foaming of the pumping medium is not considered during the pressure compensation processes.

SUMMARY OF THE INVENTION

Therefore, it is the task of the invention to provide a pump of the type named at the beginning that does not have these disadvantages.

This task is solved with a pump that has a pump chamber in which a rotary-driven pump element is mounted. The pump also has at least one suction connection that opens into the pump chamber and at least one pressure connection. In addition, the pump has circulating pumping cells with changeable volume that are connected with the suction or pressure connection depending on the rotary position of the pump element. The pump according to the invention distinguishes itself in particular by a hydraulic intermediate capacity that can be stressed with the pumping medium pressure present at the pressure connection by way of its first connection and that, by way of its second connection, can be stressed with the pumping medium pressure present at the pressure connection depending on the rotary position of the pump element or it can be connected with a pumping cell that has no direct connection to the pressure connection. If both connections of the intermediate capacity are connected with the pumping medium pressure, this intermediate capacity will be charged. However, if the second connection of the intermediate capacity is connected to the pumping cell that is not connected to the pressure connection, the intermediate capacity discharges into this pumping cell. In this design according to the invention, it is advantageous for the intermediate capacity to have a certain elasticity, which on the one hand depends on its volume and on the other hand on the degree of foaming of the pumping medium itself. This means that at low degrees of foaming the storage effect of the intermediate capacity is low and it is high with high degrees of foaming. This is advantageous to the extent that, with low degrees of foaming, a correspondingly lower volume flow is also necessary in order to pre-stress the pumping medium in the cell. The pressure compensation process is determined mainly by the magnitude of the resistance connected in series in the two connections. With high degrees of foaming, a correspondingly higher volume flow is necessary, which is met by the large storage effect of the intermediate capacity at high degrees of foaming. With high degrees of foaming, the intermediate capacity is thus relieved at the beginning of the pressure compensation process in the direction of the pumping cell to be filled and in this period provides for a faster pressure increase. If this compensating process is completed, the operating pressure must now recharge both the cell to be filled and the intermediate capacity. This results in a pressure increase in the pumping cell that is more gradual overall. This more gradual pressure increase is advantageous and desirable because with a high percentage of undissolved air in the oil, the elasticity is high at lower pressure and lower at high pressure. This means the elasticity curve is very progressive. With low pressure in the pumping cell to be filled, this requires a higher volume flow, which is provided in that the intermediate capacity is relieved and/or discharged and at higher pressures in the cells to be filled, a lower volume flow is provided in that the intermediate capacity and the cell are charged.

According to an advantageous embodiment, the first connection of the intermediate capacity is connected to the pressure connection. This means that the first connection is directly in connection with the pressure connection on the pump chamber side. In this process, it is advantageous if the intermediate capacity is arranged in the immediate area of the pressure connection so that very long connectors between the pressure connection and the intermediate capacity are not necessary.

In a further development of the invention, it is provided that the second connection of the intermediate capacity opens into the wall of the pump chamber and is brushed over by the pump elements delimiting the pumping cells. In this way, it is especially easily possible to control the charging and discharging process of the intermediate capacity. This means that a charging and discharging of the intermediate capacity is insured based on the rotation of the pump element alone. This means that in an especially advantageous manner, additional control elements can be dispensed with. Because of the fact that the second connection opens into the pump chamber wall and in a preferred embodiment the first connection of the intermediate capacity is directly connected to the pressure connection, control of the charging and/or discharging process is carried out simply because of the fact that the pump elements brush over the openings of the connections so that the opening of the second connection is closed or released by the pump element and namely in such a way that both connections are connected with the pumping medium pressure or the first connection is stressed with the pumping medium pressure and the second connection is connected with the pumping cell to be filled. Overall, the result of this is an especially simple design in which the control can also be carried out very easily but still very reliably.

In a preferred embodiment, the intermediate capacity has about double the volume of one pumping cell. Because of variation of the volume, the elasticity of the intermediate capacity mentioned above can be adjusted so that the storage effect of the intermediate capacity can be coordinated to the degrees of foaming that are present.

Especially preferred is an embodiment in which a hydraulic resistance lies in the first and/or second connection of the intermediate capacity. This results in advantages during low degrees of foaming of the pumping medium, in which the pressure compensation process is mainly determined by the size of the resistances connected, preferably in series, to the intermediate capacity. The intermediate capacity itself has somewhat less of an effect with these degrees of foaming.

In one embodiment, it can be provided that the intermediate capacity is formed of at least two partial capacities which are connected in series in an especially preferred embodiment. Between the two partial capacities, a hydraulic resistance can be mounted. In a preferred embodiment, a series connection of partial capacity, hydraulic resistance and partial capacity thus results. If in addition hydraulic resistances are present in the first and/or second connections, they are also preferably connected in series so that overall only series connections of the hydraulic resistances and partial capacities result.

In a preferred embodiment, the intermediate capacities are formed in the pump housing. Alternatively or additionally, the intermediate capacity can also be arranged in the wall of the pump chamber, turned away from the pump chamber. Naturally, combination possibilities are also conceivable. If the intermediate capacity lies in the pump housing, it is still mounted very close to the pump chamber so that long connection paths for the intermediate capacity are avoided.

A preferred embodiment of the pump is characterized in that the pump chamber is formed of a pump chamber ring and at least one pressure plate lying on the face sides of the pump chamber ring and/or is delimited by the pump housing, whereby in a preferred embodiment a hydraulic resistance lies in one of the pressure plates and the intermediate capacity lies in the pump housing. In this way, the hydraulic resistances can be implemented by using simple openings with small cross section which simultaneously form the first and second connection of the intermediate capacity. Then the intermediate capacity lies behind the pressure plate as a recess that is covered by the pressure plate and is connected with the openings in the pressure plate. The intermediate capacity and/or at least one hydraulic resistance can thus lie in one of the pressure plates and/or in the pump chamber ring and/or in the pump housing.

In a preferred embodiment, the hydraulic resistance lies between the wall adjacent to the pump element and the wall turned away from this wall (outer wall) of the pump chamber. In this way, the hydraulic resistance can easily be produced by an opening, preferably a stepped opening.

In order to avoid leakage, in the design just mentioned, it is preferably provided that the transition from the hydraulic resistance to the intermediate capacity is sealed in such a way that the pumping medium cannot flow between the surfaces of the pressure plate and the pump housing, i.e. the passage is sealed from other pressure areas.

An embodiment is preferred in which the second connection of the intermediate capacity that opens into the pump chamber wall has a circular cross section. Openings such as this can be produced especially simply using drilling, punching or eroding, whereby material-removing methods are preferred in which no chips develop.

In one embodiment, it is provided that the opening area of the second connection is circular. However, in another embodiment it can be provided that this opening area in the pump chamber wall is expanded at least in some areas. This means that opening cross section expansions can be provided that can be formed e.g. by slots in the pump chamber wall. Because of the slots, influence can also be exerted on the volume flow that flows into the cell to be filled. In addition, the slots can have a constant or a changing cross section. This means that the volume flow entering the cell to be filled can be influenced in relationship to the rotational position of the pump element. In addition, a slowly increasing volume flow can be provided if slots are used whose cross section is smaller in the direction opposite the direction of rotation of the rotor. This is especially advantageous with low degrees of foaming.

Naturally the pump can have several suction and pressure connections. This means that a multi-stroke pump can be provided, whereby intermediate capacities are designed according to the number of pressure connections. Preferably one intermediate capacity is thus provided for each pressure connection.

In an especially preferred case, the pump according to the invention is a vane-cell or roller-cell pump in which the pump elements are formed as vanes or rollers. In an especially preferred case, the pump is used in automatic transmissions for the supply of operating medium for the engine speed transferring means and/or hydraulic control elements since especially in automatic transmissions oil is present with greatly differing degrees of foaming.

In one embodiment of the pump, one of the pressure plates is supported against the pump housing by way of a spacer as is described in DE 199 00 927 A1.

In addition, an embodiment is preferred in which the pressure connection and/or the suction connection has an opening expansion so that the pressure-compensating process is controlled both by the intermediate capacity and by the slots.

BRIEF DESCRIPTION OF THE DRAWINGS

In the following, the invention will be explained in more detail with reference to the drawing. The following are shown.

DETAILED DESCRIPTION

Figures 1A, 1B:
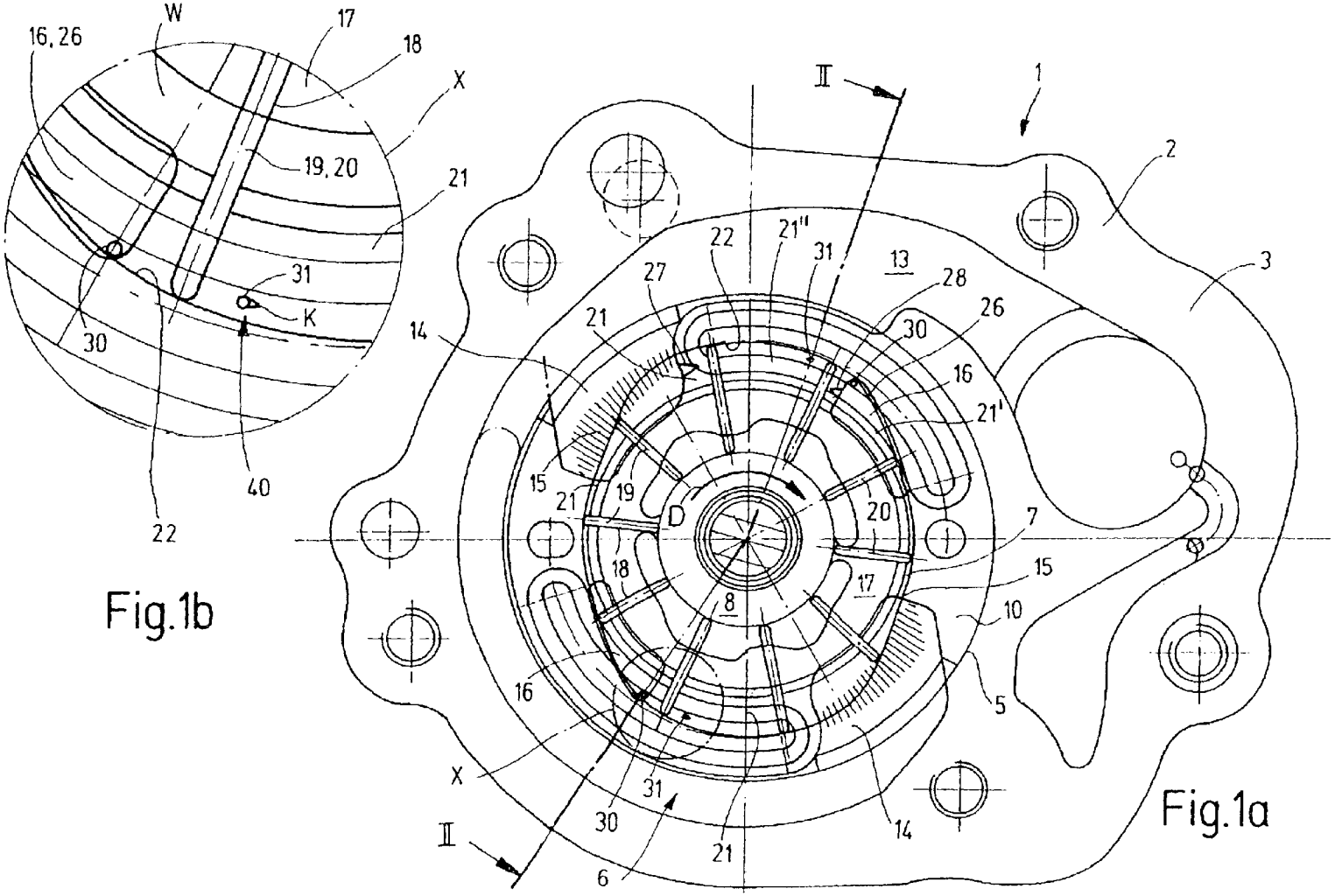
FIG. 1*a* shows a pump with open pump chamber.
FIG. 1*b* shows a cut-out enlargement of the detail designated with X in FIG. 1*a,*

Using FIGS. 1*a* and 2, in the following a pump 1 will be described that is designed as a vane-cell pump. In FIG. 1*a*, pump 1 is shown with open housing as results along section line Ia—Ia from FIG. 2. Pump 1 has a pump housing 2 that can be designed in multiple parts, especially two parts, so that—as in the embodiment here—a housing base 3 and a housing cover 4 can be present. The housing base 3 has a recess 5 in which a pump insert 6 is mounted. It has a pump chamber 7 and a pump element 8 that is mounted in the pump chamber 7 so that it can be driven in rotation. Pump element 8 is driven by way of a drive shaft 9 mounted in housing 2, which thus passes through housing 2 and/or housing cover 4. At one of its ends, drive shaft 9 is fastened tight to pump element 8. At the other end of the drive shaft that is not shown here, a drive torque can be initiated in drive shaft 9.

Pump chamber 7 is delimited by a pump chamber ring 10 and two pressure plates 11 and 12 lying on the face sides of the pump chamber ring. However, pump chamber 7 can also be delimited by the pump chamber ring 10, one of the pressure plates 11 or 12, and the pump housing 2. Around the pump chamber ring 10, a spiral-shaped suction chamber 13 is formed that can be connected with a reservoir not shown here for a pumping medium. An opening 14 is formed between the pump chamber ring 10 and at least one of the pressure plates 11 and/or 12, which opens into the pump chamber 7 and thus connects suction chamber 13 with pump chamber 7 and thus produces a suction connection 15. By means of pump element 8, pumping medium is brought into pump chamber 7 by way of the suction connection 14, pumped and driven out at a pressure connection 16 on pump chamber 7. For this purpose, pump element 8 has a rotor 17 that can be driven in rotation. Radial slots 18 are formed in the rotor, in each of which a vane 19 is mounted that can be radially displaced. Vanes 19 form pump elements 20 that delimit pumping cells 21—seen in direction of rotation D. The pumping cells 21 are delimited radially on the outside by a sliding surface 22 of pump chamber ring 10, on which pump elements 20 glide or roll. As can be seen in FIG. 2, the pumping cells 21 are delimited radially by pressure plates 11 and 12. Because of the cross section shape of the opening of pump chamber ring 10, the volume can be changed in pumping cells 21. With a rotation of rotor 17, the pumping cells 21 rotate inside pump chamber 7 so that they are in connection alternately with the suction connection 15 and the pressure connection 16. As already mentioned, the present embodiment is a vane-cell pump. However, pump 1 can also be designed as a roller-cell pump. Then instead of vanes 19, roller-type pump elements 20 will be provided that lie in the corresponding recesses in rotor 17.

Pressure connection 16 opens into a pressure chamber 23 that lies in housing 2, especially in housing base 3, and is formed here, purely as an example, by one section of recess 5 and delimited by pressure plate 11. By means of a seal 24, the pressure chamber 23 is closed off from suction chamber 13. Pressure chamber 23 is connected to a consumer connection 25, at which a consumer that is not represented here can be connected and will be stressed with the pumping medium. A consumer can be, for example, an automatic transmission, whereby it is especially provided for this that housing 2 is flange-mounted inside the automatic transmission so that the consumer in the automatic transmission can be supplied by way of the consumer connection 25 connected with the pressure chamber.

In the embodiment shown, pump 1 is designed as a double-stroke pump. Therefore, it has two pressure connections 16 and two suction connections 15. Naturally, a one-stroke pump with one pressure connection 16 and one suction connection 15 can also be provided. Naturally, pumps can also be made whose pump chambers have more than two suction and two pressure connections.

Pressure connection 16 opens into pump chamber 7, preferably in a pressure nodule 26, as it is called, that can be formed in pressure plate 11 and/or 12. The suction connection 15 can open into a suction nodule, as it is called, as can be seen particularly from FIG. 1*a*. Opening expansions 27 and/or 28 can be formed both in the suction and in the pressure nodules that are preferably formed as slots whose cross section is expanded in the direction of rotation of the rotor, as is shown in the opening expansion 28, or that are designed so that they decrease in cross section in the direction of rotation of the rotor, as is shown by the opening expansion 27.

Pump 1 has at least one hydraulic intermediate capacity 29, which can hold pumping medium in intermediate storage and release it again. For the intermediate storage of pumping medium, the intermediate capacity 29 is stressed with the pumping medium pressure available at pressure connection 16 depending on the rotary position of pump element 8. In another rotary position, the pumping medium in intermediate storage is released to a pumping cell 21 that is not connected with either the suction connection 16 or the pressure connection 15. The intermediate capacity 29 is charged when its first connection 30 and its second connection 31 lie within one pumping cell 21 that has a direct connection to the pressure connection 16. FIG. 1*a* shows a rotor position in which the first connection 30 lies within a first pumping cell 21' and the second connection lies in a second pumping cell 21" whereby this pumping cell 21" has no direct connection with the suction connection 15 or the pressure connection 16. The two connections 30 and 31 are thus arranged at a distance from each other—in the circumference direction of rotor 17.

In a preferred embodiment, the first connection of the intermediate capacity 29 is connected directly with the pressure connection 16, as can be seen in FIGS. 1*a* and 1*b*. The second connection 31 of intermediate capacity 29 opens into wall W of the pump chamber, and namely in the area of wall W, that is brushed over by pumping cells 21, 21', 21", i.e. turned toward rotor 17. In a preferred embodiment, the second connection 31 opens into the surface of pressure plate 12 turned toward rotor 17. Naturally, the second connection 31 of intermediate capacity 29 could also open into the gliding surface 22. This naturally also applies to the first connection 30 of intermediate capacity 29.

Figure 2:
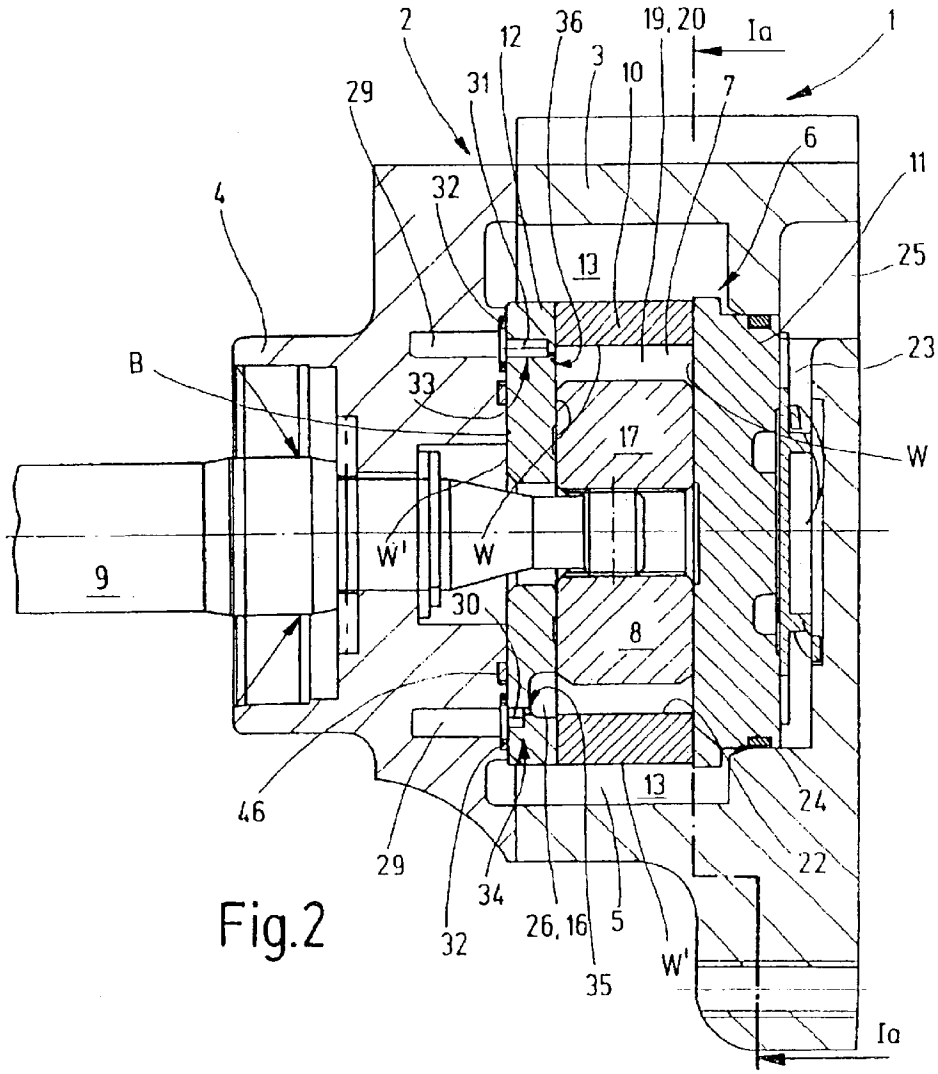
FIG. 2 shows a cross section of the pump according to FIG. 1*a*, whereby the cross section lies along the line II—II in FIG. 1*a,*

As FIG. 2 shows, the intermediate capacity 29 lies in housing 2, especially in housing cover 4, pump 1 and the first and/or second connection 30, 31 are formed in pressure plate 12. So that the pumping medium cannot get between the contact surfaces between pressure plate 12 and housing cover 4, sealing means 32 are provided that—as FIG. 2 shows—can be formed in housing 2, especially housing cover 4, or even in pressure plate 12.

Connections 30 and 31 are made in pressure plate 12 as openings that preferably have circular cross sections. Preferred is an embodiment in which the openings 33 and/or 34 are designed as stepped openings. Within the first and/or second connections, i.e. within openings 33 and/or 34, hydraulic resistors 35 and/or 36 are formed that thus lies in series with the intermediate capacity 29. It is clear that the intermediate capacity 29 can also lie in wall W' of pump chamber 7 according to one embodiment, whereby this wall W' forms the outer wall of pump chamber 7. In this way, the intermediate capacity 29 can also lie in pressure plate 11 and/or 12 and/or in pump chamber ring 10. It can naturally also—as shown—lie in one of housing parts 3 and/or 4. The same is also true for the hydraulic resistances and for the openings 33 and 34. In the embodiment shown, the hydraulic resistances 35 and 36 lie between wall W and outer wall W' of pump chamber 7.

Figure 3:
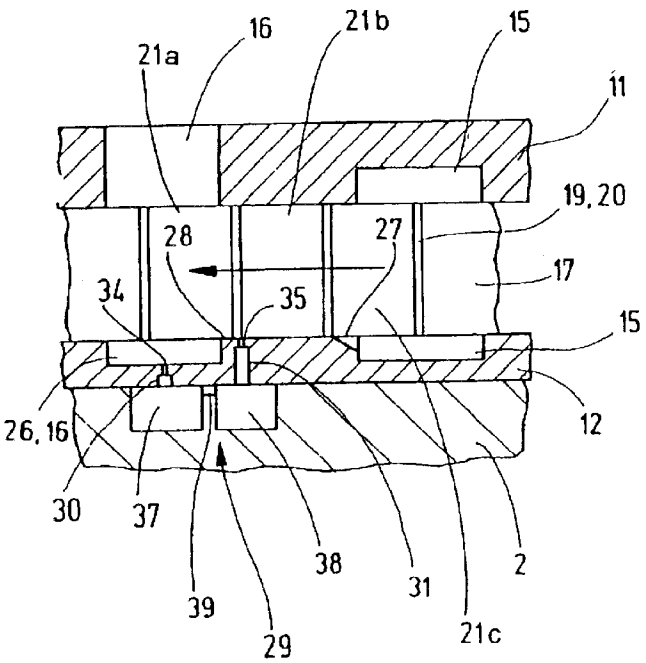
FIG. 3 shows a schematic diagram of a section of an unwound" rotor.

As FIG. 3 shows, the intermediate capacity 29 can also comprise several partial capacities 37, 38 connected with each other, whereby the first partial capacity 37 is in connection with the first connection 30 and the second partial capacity is connected with the second connection 31. Both partial capacities 37 and 38 are connected with each other, whereby preferably a hydraulic resistance 39 is connected between them. A series connection thus results of hydraulic resistance 34, partial capacity 37, hydraulic resistor 39, partial capacity 38, and hydraulic resistance 35. The capacity of the intermediate capacity 29 is dimensioned such that it has about twice the volume of one pumping cell 21*a*, 21*b* or 21*c*. The volume of the intermediate capacity is to be divided accordingly if partial capacities 37, 38 are planned. The volumes of the partial capacities 37, 38 can be equal or different. In addition, a parallel connection of partial capacities with the same or different volume would be conceivable.

Figure 5:
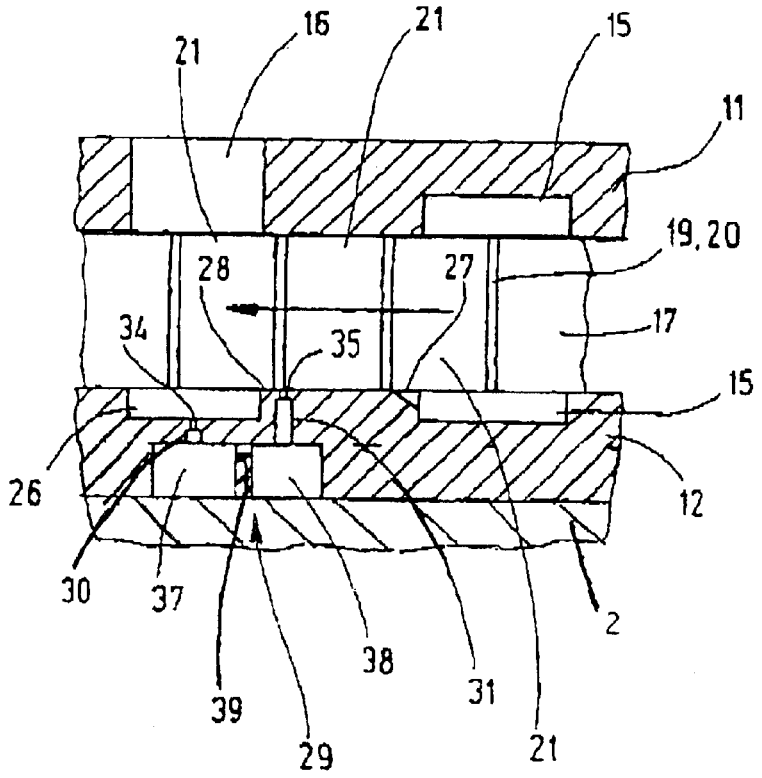
FIG. 5 shows a schematic diagram of a section of the pump chamber where the intermediate capacity is formed in a pressure plate.

In the embodiments mentioned above, intermediate capacity 29 is formed in pump housing 2. However, with a correspondingly larger design of pressure plate 12, it would also be conceivable to produce both connections 30 and 31, hydraulic resistances 35, 36, and 39, and intermediate capacity 29 in pressure plate 12, as illustrated in FIG. 5. It would also be conceivable to provide the intermediate capacity and/or the hydraulic resistances in pump chamber ring 10.

The opening areas of the first and second connections 30, 31 can be circular in one embodiment. As the enlarged diagram according to FIG. 1*b* makes clear, however, the second connection 31 can also be expanded in its opening area 40. For each opening area 40, e.g. a slot K can be provided that extends from the opening area 40 in the direction opposite the direction of rotation of rotor 17. The slots can have a constant cross section; however, it is also possible that the opening area 40 is expanded in such a way that it is expanded or narrowed in the direction of rotation or opposite the direction of rotation of the rotor.

Figure 4:
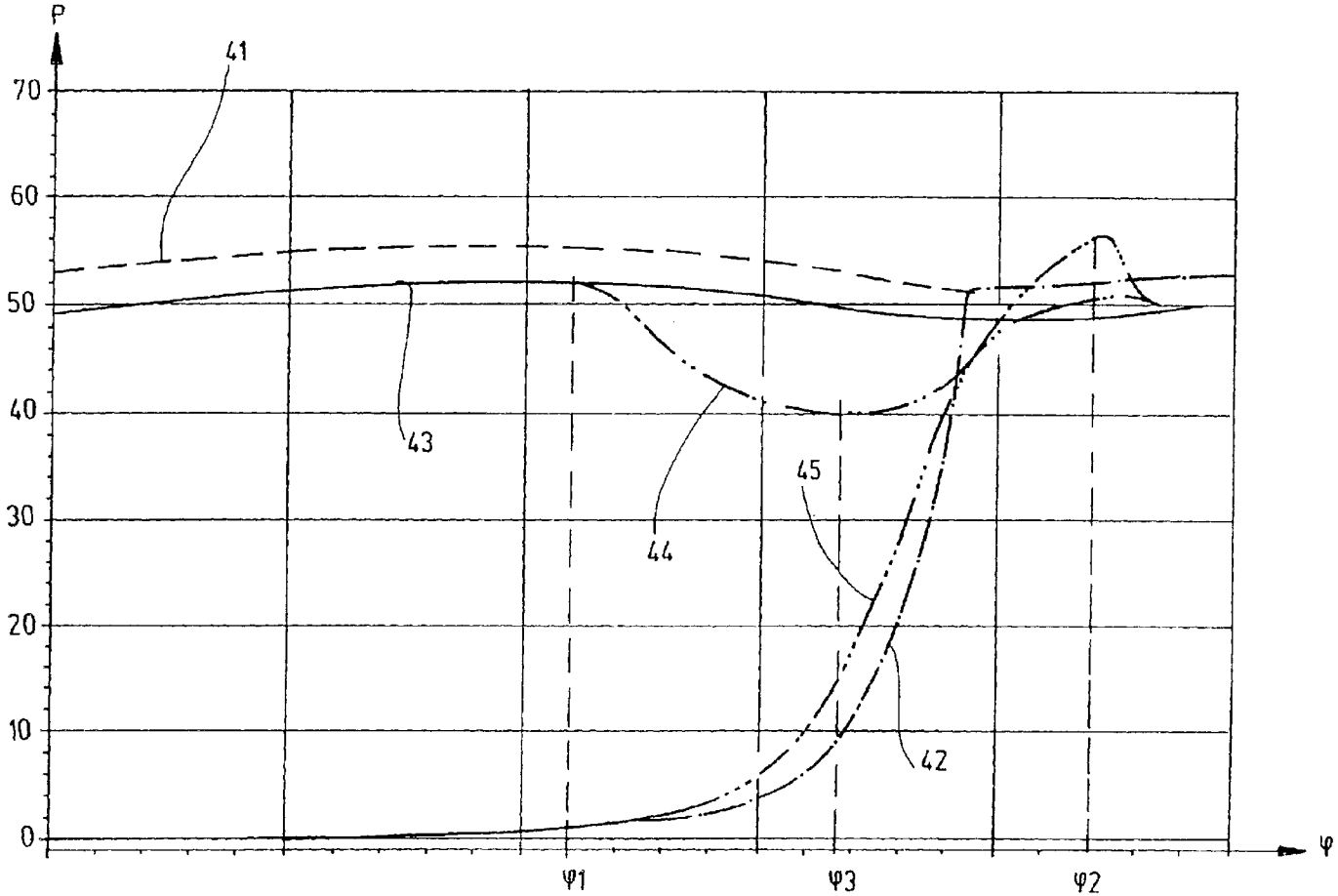
FIG. 4 shows various pressure curves of a pump according to the prior art and the pump according to the invention.

FIG. 4 shows various pressures over the angle of rotation of the pump element for a known pump without intermediate capacity 29 and for pump 1 according to the invention with intermediate capacity 29. The assignment of the graphs results from the following key:

| | | |
|---|---|---|
| 41 | --- | Operating pressure of a known pump without intermediate capacity, |
| 42 | -.- | Pumping cell pressure of the known pump, |
| 43 | — | Operating pressure of pump 1 with intermediate capacity 29, |
| 44 | -..- | Pressure in intermediate capacity 29 and |
| 45 | -...- | Pumping cell pressure of pump 1 with intermediate capacity 29. |

The following considerations apply to a pumping cell that was filled up to an angle of rotation $\phi 1$ of rotor 17 by way of suction connection 15. Starting at angle of rotation $\phi 1$, the pumping cell 21 is charged by intermediate capacity 29. Pumping cell pressure 45 thus begins to increase slightly. Pressure 44 in intermediate capacity 29 drops since it discharges into pumping cell 21.

In comparison to pressure curve 42 of a pumping cell of a known pump, a slight pressure increase results in pumping cell 21 of pump 1. Especially at high degrees of foaming of the pumping medium, the intermediate capacity is relieved in the direction of the cell to be filled, as is represented starting from angle of rotation $\phi 1$ to $\phi 3$ in FIG. 4. During further rotation of the pump element, in this period intermediate capacity 29 provides for an earlier pressure increase in pumping cell 21. Starting at angle $\phi 3$, the operating pressure now charges both the cell to be filled and the intermediate capacity 29 back up. Since the operating pressure has to charge a larger volume, resulting—as mentioned above—from intermediate capacity 29 and the cell to be filled, the pressure in pumping cell 21 increases more slowly. Exactly this behavior is desirable if, with a high percentage of undissolved air in the pumping medium at lower pressure, the elasticity of the pumping medium is high and is lower at high pressure. This means that the elasticity curve is highly progressive. This pump behavior is present in pump 1 so that at low pressure in the pumping cell to be filled 21 a higher volume flow gets into the cell, the result of which is that intermediate capacity 29 is discharged and, with higher pressures in the cell to be filled, a lower volume flow must be present in the cell to be filled, which in turn is achieved in that the intermediate capacity is charged in addition to pumping cell 21. Thus it is seen that in pump 1 with intermediate capacity 29, operating conditions can also be controlled and improved that may lie at the edge of the operating status spectrum, i.e. lower pressure and a lower degree of foaming as well as high pressure and a high degree of foaming. This means that advantageous pressure curves result over the entire rpm range of pump 1.

FIG. 2 also shows that pressure plate 12 is supported at a distance from floor B of recess 5 by way of a spacer 46. The spacer 46 can be made so that it forms a unit with housing part 4 or pressure plate 12. However, it can also exist as a separate inserted part. With spacer 46, a mechanical slot compensation is implemented, in which the area of pressure plate 12 bends in the direction of rotor 17 inside the spacer 46 and thus decreases the leakage gap. The sealing effect of the seal 32 is not influenced by this. DE 199 00 927 A1 describes the pressure plate support by means of the spacer and the gap compensation in detail.

The patent claims submitted with the application are suggestions without prejudice to more extensive patent protection. The applicant reserves the right to claim other combinations of characteristics disclosed only in the description and/or the drawings.

Retrospective effects used in subclaims refer to different designs of the object of the main claim by the characteristics of the respective subclaim; they are not to be understood as precluding the achievement of an independent, objective protection for combinations of characteristics of the retrospective subclaims.

Since the objects of the subclaims can form separate and independent inventions with respect to the prior art on the priority date, the applicant reserves the right to make use of independent claims or partial statements. They can also contain independent inventions that have a design independent of the objects of the preceding subclaims.

The embodiment examples are not to be understood as a restriction to the invention. It is much more the case that, in the scope of the present disclosure, numerous changes and modifications are possible, especially those variations, elements, and combinations and/or materials that, e.g. by combination or modification of individual characteristics and/or elements or process steps described in connection with the general description and embodiments and the claims and contained in the drawings, can be used by the person skilled in the art with respect to the solution of the task and by combining characteristics to a new object or new process steps and/or process step sequences, even to the extent that they relate to manufacturing, testing and working method.

What is claimed is:

1. A pump having a pump chamber with a rotary-driven pump element for generating a pumping medium pressure, at least one suction connection and at least one pressure connection opening into the pump chamber and with circulating pumping cells whose volume can be changed, which are connected with the suction connection or pressure connection depending on the rotary position of the pump element, and further comprising:

a hydraulic intermediate capacity having a first connection and a second connection, wherein one of said first connection or said second connection of the hydraulic intermediate capacity is connected with a pumping cell that intermittently has no direct connection to the pressure connection when said rotary-driven pump element occludes one of said first or second connections to provide a stressing of said hydraulic intermediate capacity.

2. A pump according to claim 1, wherein the hydraulic intermediate capacity has about twice the average volume of one pumping cell.

3. A pump according to claim 1, wherein a hydraulic resistance lies in the first connection and/or second connection of the intermediate capacity.

4. A pump according to claim 1, wherein the pump comprises at least one pressure plate, a pump housing and a pump chamber ring having facing sides and wherein the pump chamber is delimited by the pump chamber ring and at least one pressure plate lying on one of the face sides of the pump chamber ring and/or by the pump housing.

5. A pump according to claim 1, wherein the hydraulic intermediate capacity is formed of at least two partial capacities.

6. A pump according to claim 5, wherein at least two partial capacities are connected in series.

7. A pump according to claim 6, wherein a hydraulic resistance is positioned between the partial capacities connected in series.

8. A pump with a pump chamber and a rotary-driven pump element mounted therewithin, at least one suction connection and at least one pressure connection opening into the pump chamber and with circulating pumping cells whose volume can be changed, which are connected with the suction or pressure connection depending on the rotary position of the pump element, comprising:

a hydraulic intermediate capacity having a first connection and a second connection, wherein the hydraulic intermediate capacity can be stressed by the pumping medium pressure by way of one of the first connection or the second connection being in fluid communication with the pressure connection while the other of said first connection or said second connection is in fluid communication with an adjacent pumping cell and is intermittently occluded by said rotary-driven pump element.

9. A pump according to claim 8, wherein the pump comprises at least one pressure plate, a pump housing and a pump chamber ring having facing sides and wherein the pump chamber is delimited by the pump chamber ring and at least one pressure plate lying on one of the face sides of the pump chamber ring and/or by the pump housing.

10. A pump according to claim 8, wherein the hydraulic intermediate capacity has about twice the average volume of one pumping cell.

11. A pump according to claim 10, wherein a hydraulic resistance lies in the first connection and/or second connection of the intermediate capacity.

12. A pump according to claim 8, wherein the hydraulic intermediate capacity is formed of at least two partial capacities.

13. A pump according to claim 12, wherein at least two partial capacities are connected in series.

14. A pump according to claim 13, wherein a hydraulic resistance is positioned between the partial capacities connected in series.

15. A pump having a pump chamber with a rotary-driven pump element for generating a pumping medium pressure, at least one suction connection and at least one pressure connection opening into the pump chamber and with circulating pumping cells whose volume can be changed, which are connected with the suction connection or pressure connection depending on the rotary position of the pump element, and each pumping cell being separated from an adjacent pumping cell by a vane, the pump further comprising:

a hydraulic intermediate capacity having a first connection positioned in fluid communication with the pressure connection and a second connection positioned to be intermittently occluded by a vane separating adjacent pumping cells, depending on the rotary position of the pump element, wherein the hydraulic intermediate capacity can be stressed by the pumping medium pressure from the area of a first pumping cell via the first connection and while a second pumping cell adjacent said first pumping cell is either intermittently connected to the pressure of the pumping medium at the pressure connection via the second connection when the vane separating the pumping cells is not positioned to occlude the second connection or has no direct connection to the pressure connection when the vane is positioned during the rotation of the pump element to occlude the second connection.

16. A pump according to claim 15, wherein the second connection of the hydraulic intermediate capacity opens into the pump chamber and is brushed over by pump elements delimiting the pumping cell.

17. A pump according to claim 15, wherein the hydraulic intermediate capacity has about twice the average volume of one pumping cell.

18. A pump according to claim 15, wherein a hydraulic resistance lies in the first connection and/or second connection of the intermediate capacity.

19. A pump according to claim 15, wherein the pump comprises at least one pressure plate, a pump housing and a pump chamber ring having facing sides and wherein the pump chamber is delimited by the pump chamber ring and at least one pressure plate lying on either one of the face sides of the pump chamber ring and/or by the pump housing.

20. A pump according to claim 15, wherein the pump chamber is defined by one or more walls and wherein the hydraulic intermediate capacity is formed in one of the walls opposite to and/or turned away from the pump chamber.

21. A pump according to claim 15, wherein the pump has a wall lying inside of the pump chamber and a wall turned away from the pump chamber and wherein a hydraulic resistance lies between the wall lying inside of the pump chamber and the wall turned away from the pump chamber.

22. A pump according to claim 15, wherein the pump has a plurality of pressure areas and wherein the hydraulic intermediate capacity is sealed from other all pressure areas except the pressure connection.

23. A pump according to claim 15, wherein the pump comprises several suction and pressure connections, and a hydraulic intermediate capacity for each pressure connection.

24. A pump according to claim 15, wherein the pump is a vane-cell pump and the rotary-driven pump element is formed with a plurality of vanes.

25. A pump according to claim 15, wherein the pump comprises a housing and at least one pressure plate and wherein the at least one pressure plate is supported against the housing with a spacer.

26. A pump according to claim 15, wherein an opening expansion is formed on at least one of the pressure connection and the suction connection.

27. A pump according to claim 15, wherein an opening expansion is formed on both the pressure connection and the suction connection.

28. A pump according to claim 15, further comprising a pressure plate, a pump chamber ring, a pump housing and a hydraulic resistance, wherein the hydraulic resistance lies in at least one of the pressure and the pump housing, and wherein the hydraulic intermediate capacity lies in at least one of the pump housing and the pressure plate.

29. A pump according to claim 15, further comprising a hydraulic resistance that lies in the first connection of the hydraulic intermediate capacity.

30. A pump according to claim 15, further comprising a hydraulic resistance that lies in the second connection of the hydraulic intermediate capacity.

31. A pump according to claim 15, wherein the hydraulic intermediate capacity is formed of at least two partial capacities.

32. A pump according to claim 31, wherein at least two partial capacities are connected in series.

33. A pump according to claim 32, wherein a hydraulic resistance is mounted between the partial capacities connected in series.

34. A pump according to claim 15, further comprising a hydraulic resistance positioned in said hydraulic intermediate capacity.

35. A pump according to claim 34, wherein the pump further comprises a pressure plate, a pump chamber ring, and a pump housing, wherein the hydraulic resistance lies in at least one of the pressure plate and pump housing.

36. A pump according to claim 15, wherein the pump has a pump chamber wall and wherein the second connection of the hydraulic intermediate capacity that opens into the pump chamber wall.

37. A pump according to claim 36, wherein the second connection has a circular cross section.

38. A pump according to claim 36, wherein the second connection has an opening that is circular.

39. A pump according to claim 36, wherein the opening area of the second connection is at least partially expanded.

* * * * *